US012535298B2

(12) United States Patent
Walsh et al.

(10) Patent No.: US 12,535,298 B2
(45) Date of Patent: Jan. 27, 2026

(54) WEAPON ACCESSORY MOUNT

(71) Applicant: USA as represented by the Secretary of the Army, Washington, DC (US)

(72) Inventors: Wyatt D Walsh, Huntsville, AL (US); Marc L Roth, Huntsville, AL (US); Joshua M Williams, Huntsville, AL (US); Justin R Novak, Huntsville, AL (US)

(73) Assignee: Government of the United States, as represented by the Secretary of the Army, Washington, DC (US)

( * ) Notice: Subject to any disclaimer, the term of this patent is extended or adjusted under 35 U.S.C. 154(b) by 51 days.

(21) Appl. No.: 18/598,097

(22) Filed: Mar. 7, 2024

(65) Prior Publication Data

US 2025/0283697 A1 Sep. 11, 2025

(51) Int. Cl.
*F41G 11/00* (2006.01)

(52) U.S. Cl.
CPC ..... *F41G 11/003* (2013.01); *F41G 11/008* (2013.01)

(58) Field of Classification Search
CPC ..... F41G 11/003; F41G 11/008
See application file for complete search history.

(56) References Cited

U.S. PATENT DOCUMENTS 465,088 A * 12/1891 Patchen ..... F41G 11/007 42/125
3,834,035 A * 9/1974 Merrill ..... F41G 1/08 42/133
4,317,304 A * 3/1982 Bass ..... F41G 11/001 42/125
8,505,229 B2 * 8/2013 Savoy ..... F41G 11/003 42/148
D802,077 S * 11/2017 Geissele ..... D22/109
D831,778 S * 10/2018 Geissele ..... D22/109
12,055,367 B2 * 8/2024 Lee ..... F41G 11/001
2010/0236124 A1 * 9/2010 Troy ..... F41C 23/16 42/90
2012/0085013 A1 * 4/2012 Cahill ..... F41C 27/00 42/96
2012/0131838 A1 * 5/2012 Edge ..... F41G 11/006 42/90
2012/0180365 A1 * 7/2012 Savoy ..... F41G 11/003 42/90

(Continued)

*Primary Examiner* — Joshua E Freeman

(57) ABSTRACT

A weapon accessory mount for removably mounting an accessory on a weapon. The weapon accessory mount includes an accessory rail supported by a base with a weapon attachment interface that engages the weapon. The weapon attachment interface includes an alignment pin that interfaces a portion of the weapon and a retaining pin that couples to an additional portion of the weapon. The accessory rail utilizes mounting grooves to interchangeably couple weapon accessories to the weapon accessory mount. Furthermore, accessory interference locators are located within some of the mounting grooves to define weapon-accessory-specific locations along the accessory rail, in which a weapon accessory should not be mounted to. Additionally, the weapon accessory mount is configured for mounting non-boresight aligned optics to a weapon and locating the non-boresight aligned optic in relation to the weapon to use in tracking a target.

20 Claims, 9 Drawing Sheets

(56) References Cited

U.S. PATENT DOCUMENTS

| | | | | |
|---|---|---|---|---|
| 2015/0020429 | A1* | 1/2015 | Savoy | F41G 11/008 42/111 |
| 2017/0254615 | A1* | 9/2017 | Kennair, Jr. | F41G 11/003 |
| 2017/0299337 | A1* | 10/2017 | Ding | F41G 11/004 |
| 2018/0058816 | A1* | 3/2018 | Geissele | F41A 3/66 |
| 2023/0096361 | A1* | 3/2023 | Itshaky | F41G 11/008 42/90 |
| 2023/0184517 | A1* | 6/2023 | Davis | F41G 1/02 42/90 |

* cited by examiner

WEAPON ACCESSORY MOUNT

STATEMENT OF U.S. GOVERNMENT INTEREST

The invention described herein may be manufactured, used, and licensed by or for the U.S. Government. The government of the United States has certain rights in the invention.

FIELD

This disclosure generally pertains to a weapon accessory mount for mounting accessories to a weapon.

BACKGROUND

Weapon accessory mounts are commonly used to adapt various weapons with weapon accessories such as scopes, sights, range finders, etc. The type of weapon accessory to be used is dependent on a wide variety of parameters such as weapon type, desired weapon alignment type, environmental factors, operational factors, etc. A weapon accessory mount suitable for adapting various weapons with a plurality of different weapon accessory types to account for these parameters is desired.

Generally conventional weapon accessory mounts are complex in design and contain a number of moving parts that require additional maintenance and tools. In some instances, these mounts and additional tools required for securing the mounts to the weapon can require the operator to carry additional weight in the field. The additional maintenance required to operate the moving parts can also increase the time it takes to secure a weapon accessory to a weapon, which is undesirable in fast-paced environments. Therefore, a need for a portable, lightweight, weapon accessory mount that comprises minimal moving parts and can be quickly used to secure a weapon accessory to a weapon is desired.

SUMMARY

In one aspect, a weapon accessory mount for removably adapting a weapon with various weapon accessories under various conditions. The weapon accessory mount includes an accessory rail for attaching a weapon accessory to, that is supported on a base of the weapon accessory mount. The weapon accessory can be secured to the accessory rail within a plurality of mounting grooves on the accessory rail. Accessory interference locators within the mounting grooves define weapon-accessory-specific locations in which the weapon accessory should not be mounted to. The base of the weapon accessory mount includes a weapon attachment interface that is configured to engage with a weapon. The weapon attachment interface includes an alignment pin and retaining pin. The alignment pin rotably interfaces with a pin receiver of the weapon, and the retaining pin couples to a pin retainer of the weapon.

In another aspect, a method of securing a weapon accessory mount to a weapon comprises inserting an alignment pin of the weapon accessory mount into a weapon pin receiver; and with the alignment pin in the weapon pin receiver, rotating the weapon accessory mount about an axis of the alignment pin until a retaining pin of the weapon accessory mount is received in a weapon pin retainer. Additionally, the method includes coupling a weapon accessory to a weapon accessory rail of the weapon accessory mount by coupling a mounting tongue of the weapon accessory to a mounting groove of the weapon accessory rail that does not have an accessory interference locator within.

Other aspects will be in part apparent and in part pointed out hereinafter.

BRIEF DESCRIPTION OF THE DRAWINGS

Corresponding parts are given corresponding reference characters throughout the drawings.

DETAILED DESCRIPTION

Figure 1:
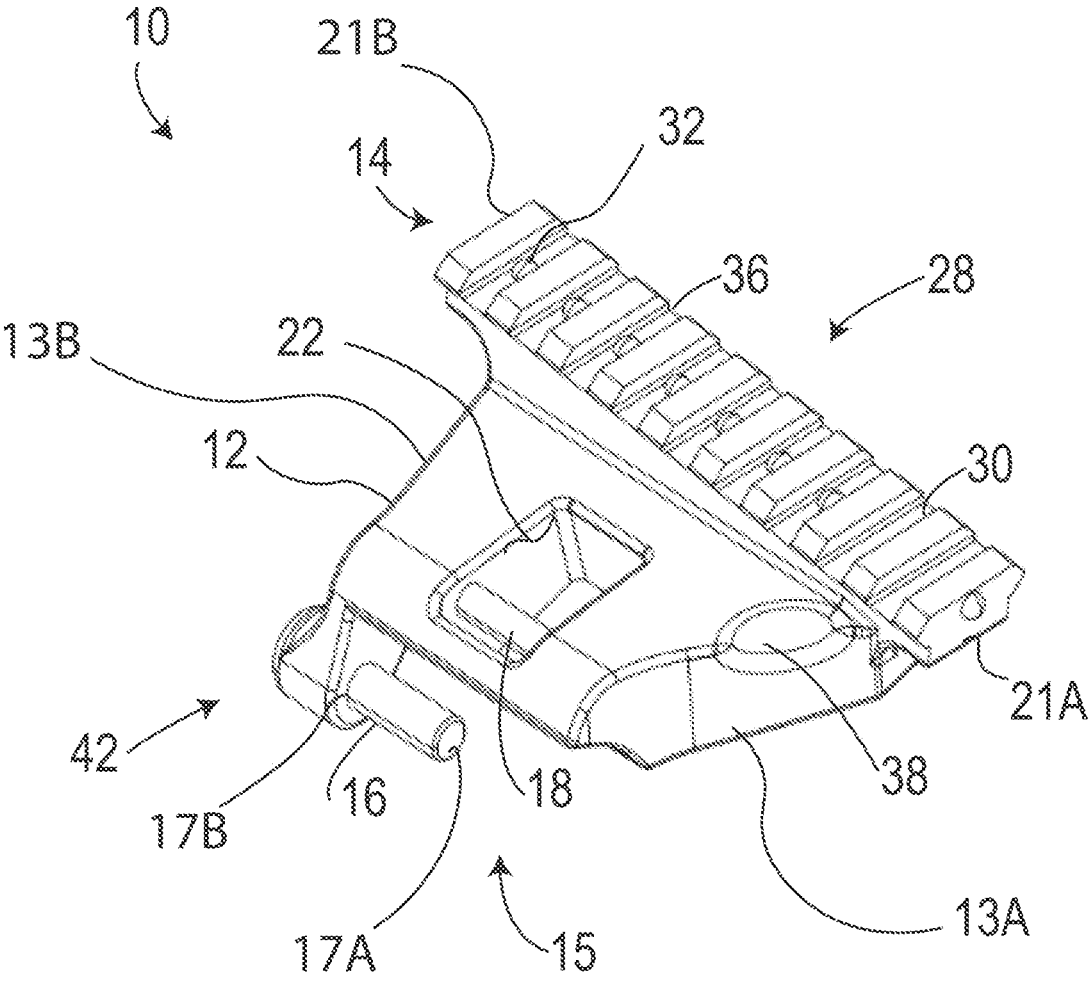
FIG. 1 is a perspective of a weapon accessory mount.

Referring now to FIGS. 1-9, a weapon accessory mount for mounting an accessory on a weapon W is generally indicated at reference number 10. The weapon accessory mount 10 generally comprises a base 12 and an accessory rail 14 (e.g., a Picatinny rail, Weaver rail, M-LOK, etc.) on the base 12. The base 12 defines a weapon attachment interface 15 for attaching the weapon accessory mount 10 to the weapon W. As will be explained in further detail below, the weapon accessory mount 10 comprises an alignment pin 16 and a retaining pin 18 configured to attach by (1) inserting the alignment pin into a weapon pin receiver R1 and then rotating the weapon accessory mount in a rotational direction RD about an axis PA1 of the alignment pin 16 until the retaining pin 18 of the weapon accessory mount is received in a weapon pin retainer R2.

Figure 2:
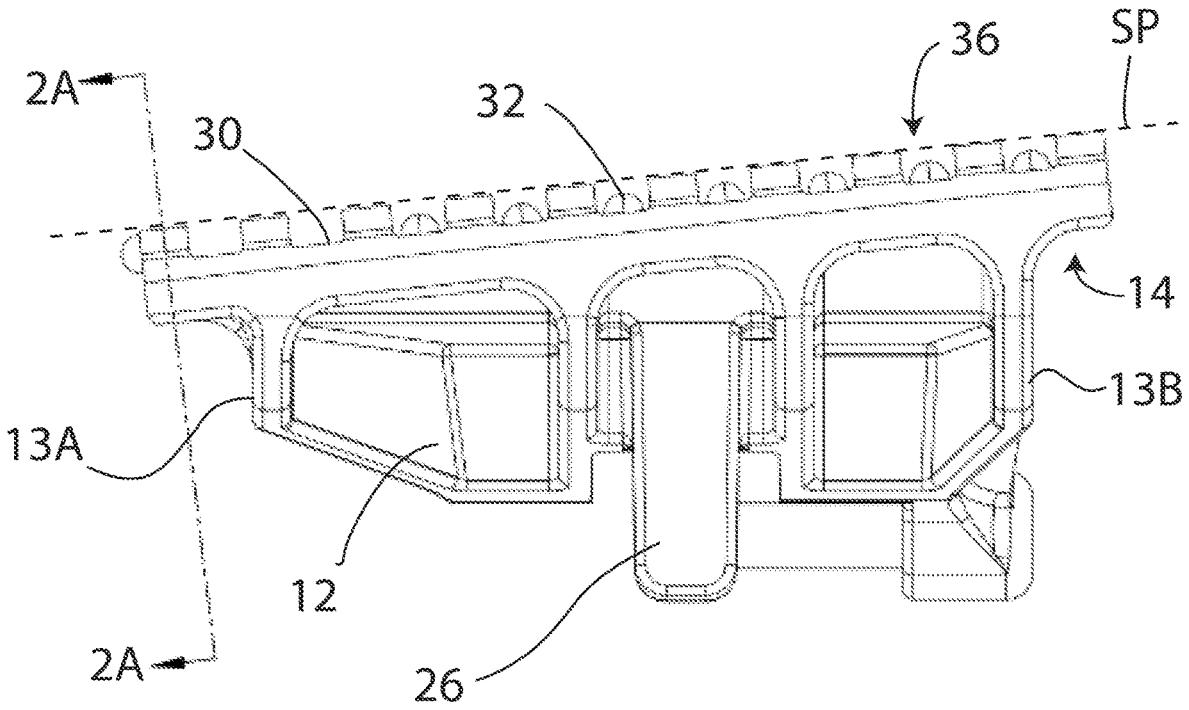
FIG. 2 is an elevation of the weapon accessory mount.
Figure 2A:
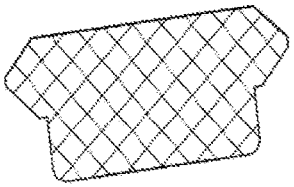
FIG. 2A is a cross-section of the weapon accessory mount taken in the plane of line 2A-2A of FIG. 2.

In general, the base 12 comprises a first side portion 11A and second side portion 11B spaced apart along a lateral axis LTA of the weapon accessory mount 10 and a front end portion (generally towards a target of interest) 13A and a rear end portion (generally towards a weapon operator) 13B spaced apart along the alignment pin axis PA1. The weapon accessory mount 10 has a vertical axis VA perpendicular to the alignment pin axis PA1 and the lateral axis LTA. In one or more embodiments, the weapon attachment interface 15 is configured to couple to the weapon W such that the alignment pin axis PA1 is aligned parallel with the bore of the weapon W. The weapon attachment interface 15 is located along the first side portion 11A of the base 12, near the rear end portion 13B. By contrast, the accessory rail 14 is on top of the base 12 along the opposite second side portion 11B. The accessory rail 14 is supported on the second side portion 11B of the base 12 such that the weapon accessory mount 10 is configured to mount the accessory rail on the weapon W at a location that is laterally offset from where the weapon mount interface 15 attaches the weapon accessory mount to the weapon W. As shown in FIG. 2, the base 12 can further comprise a stabilization leg 26 extending downward, that can transfer a load of a weapon accessory to the weapon accessory mount 10.

In the illustrated embodiment, the base 12 and the accessory rail 14 are formed from a single piece of monolithic material. The base 12 and accessory rail 14 can be manufactured using known techniques such as 3D printing, injection molding, etc. In the preferred embodiment, the weapon accessory mount 10 can be optimized for injection molding. Such optimization can include the base 12 of the weapon accessory mount 10 comprising a hollow interior on a bottom side portion of the base 12. A thermal stability rib 24 (shown in FIG. 7) can also be incorporated into the rear end portion 13B of the base 12 for ease of manufacturing.

In the illustrated embodiment, the alignment pin 16 has a front end portion 17A and a rear end portion 17B spaced apart along the alignment pin axis PA1. The rear end portion 17B of the alignment pin 16 anchors to the base 12, such that the alignment pin 16 is cantilevered from the rear end portion 13B of the base 12. The rear end portion 17B of the alignment pin 16 is anchored to a lower back corner protrusion 42 of the base 12. The lower back corner protrusion 42 extends downward and laterally outward, away from the accessory rail 14. The alignment pin axis PA1 is parallel to an axis RA1 of the retaining pin 18.

Figure 3:
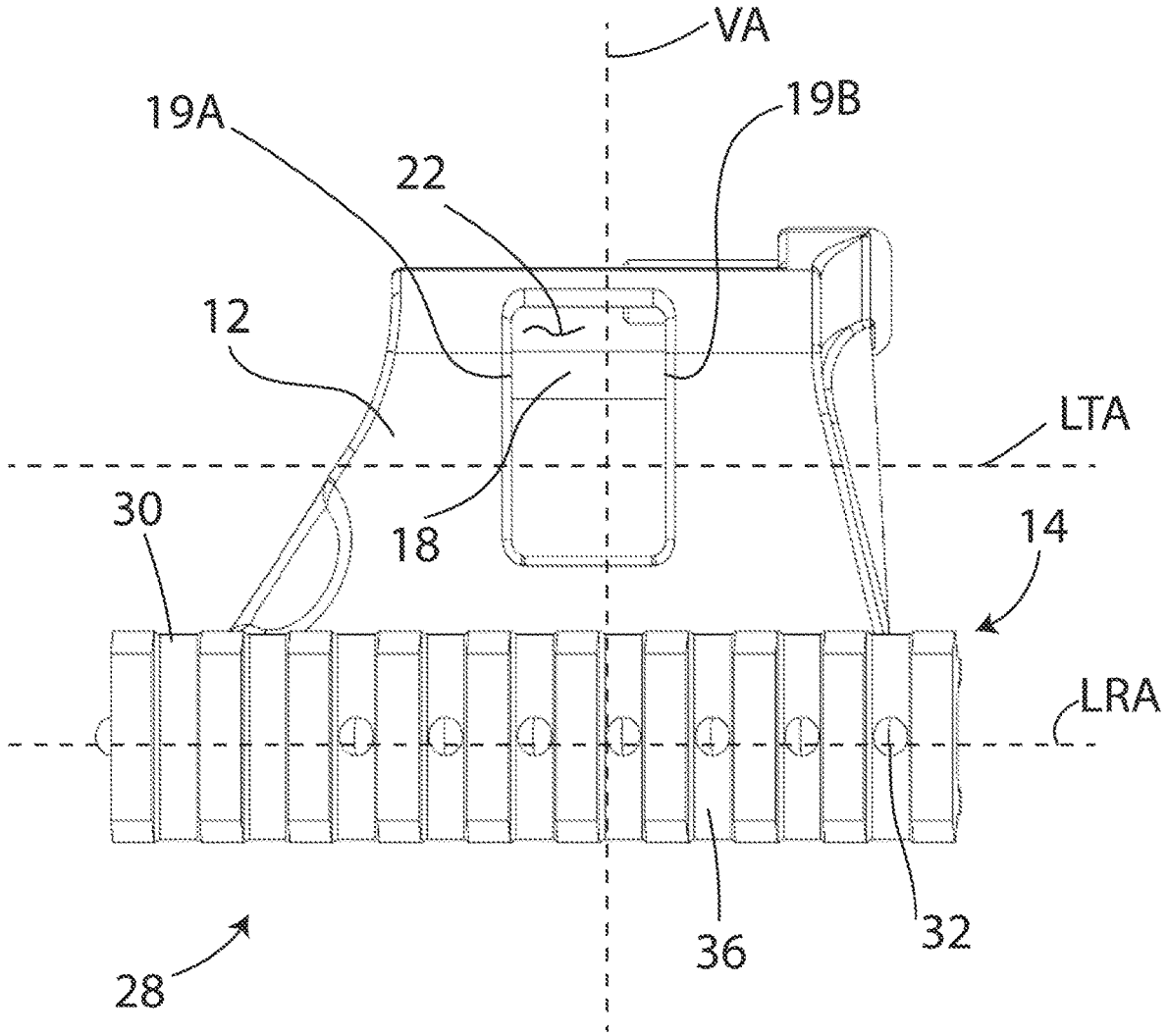
FIG. 3 is a top plan view of the weapon accessory mount.
Figure 4:
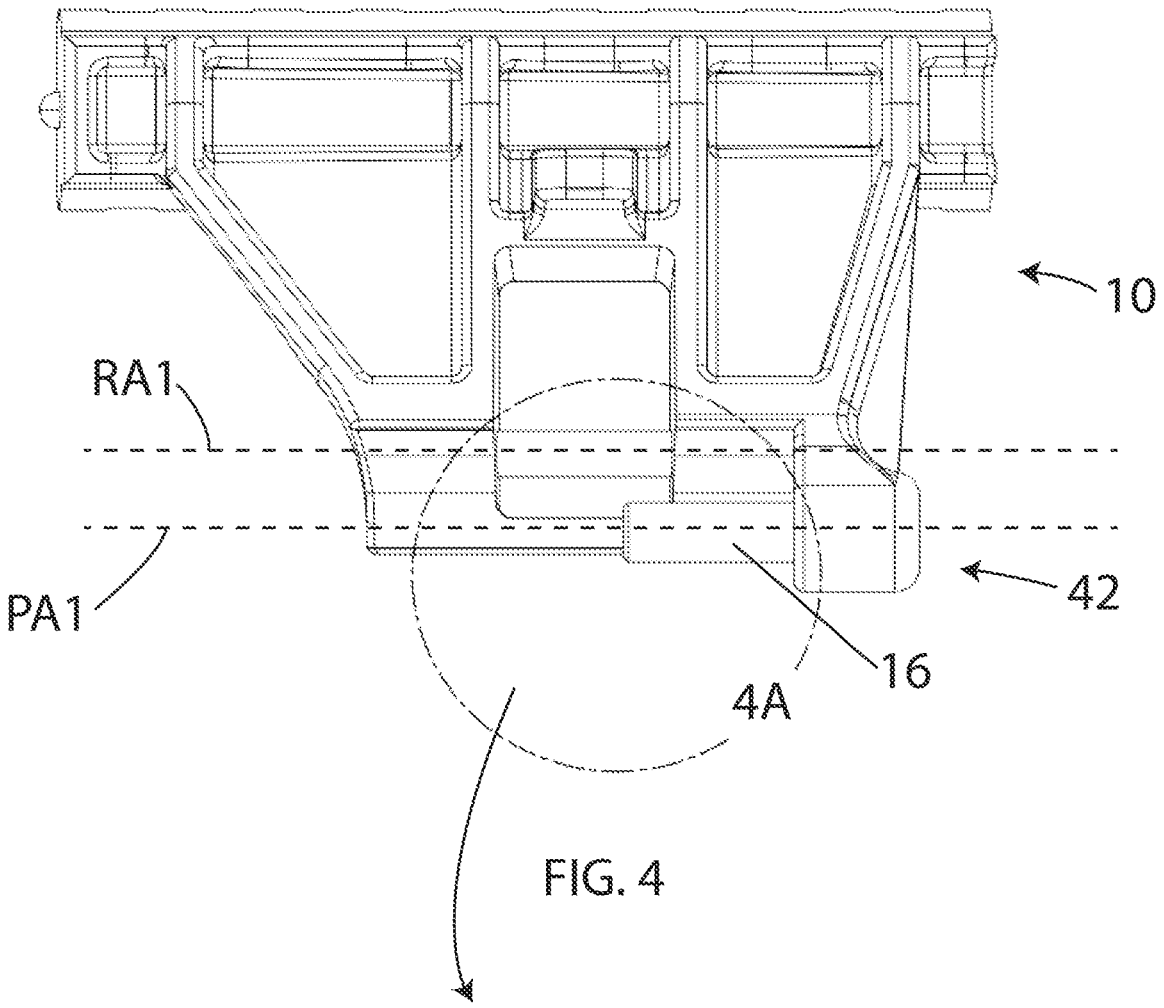
FIG. 4 is a bottom plan view of a weapon accessory mount.
Figure 4A:
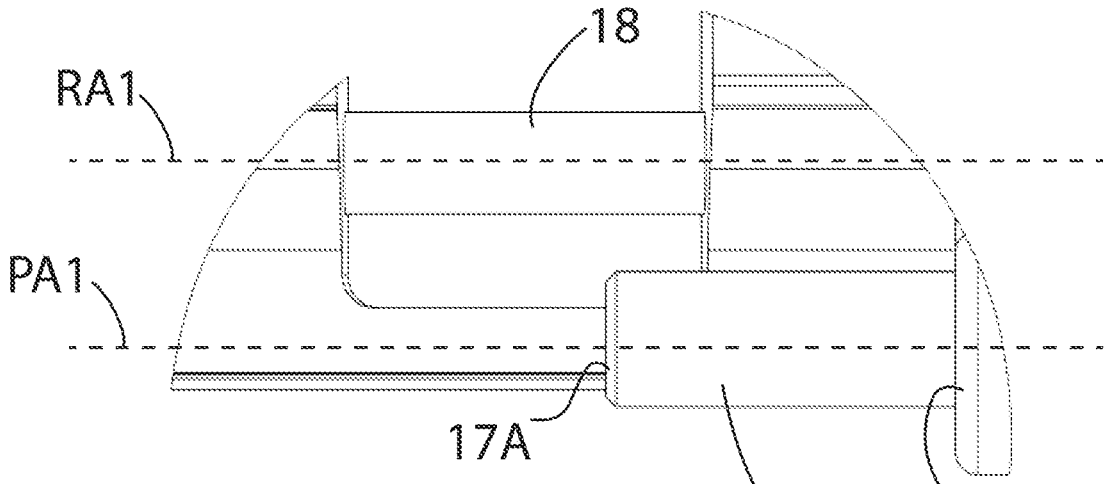
FIG. 4A is an enlarged view of a portion of FIG. 4.

The retaining pin 18 is anchored to the base 12 and configured to couple to the weapon W. The retaining pin 18 comprises a front end portion 19A anchored in the front end portion 13A of the base 12 in front of a retaining pin recess 22 of the base 12 and a rear end portion 19B anchored in the rear end portion 13B of the base 12 behind the retaining pin recess 22 such that the retaining pin 18 is supported from both the front and rear end portions. The front end portion 19A and rear end portion 19B are best seen in FIG. 3. The retaining pin recess 22 is between the lower back corner protrusion 42 and the accessory rail 14. The front end portion 19A of the alignment pin 16 is aligned with the retaining pin recess 22 such that a plane extending radially from a front end portion of the alignment pin axis PA1 intersects the retaining pin 18. The retaining pin 18 is spaced apart from the alignment pin 16 along the lateral axis LTA of the weapon accessory mount 10 such that the retaining pin 18 is laterally between the alignment pin 16 and the accessory rail 14 and is vertically above the alignment pin 16.

Figure 5:
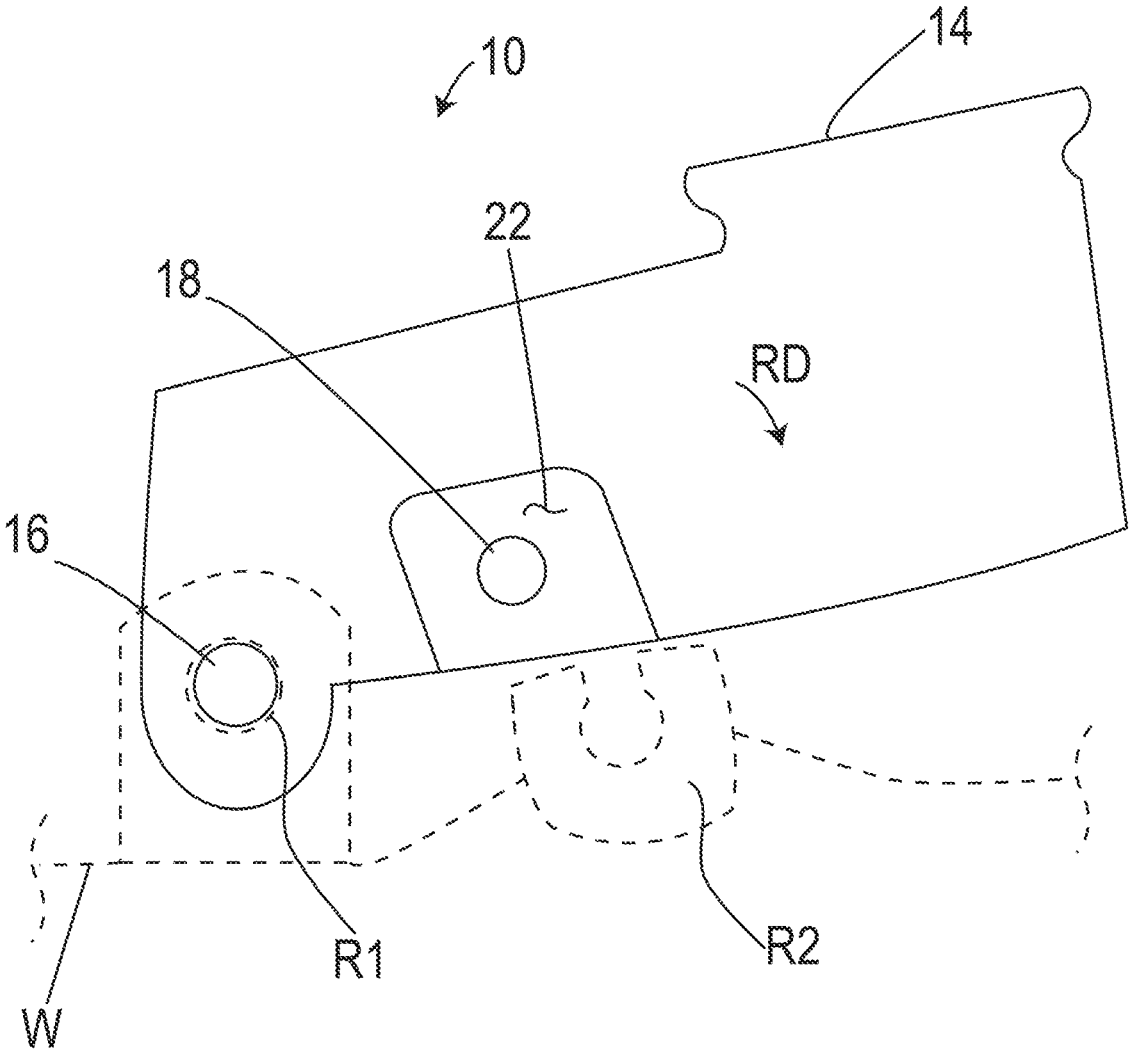
FIG. 5 is a schematic illustration showing the weapon accessory mount at a first installation position in relation to a weapon.
Figure 6:
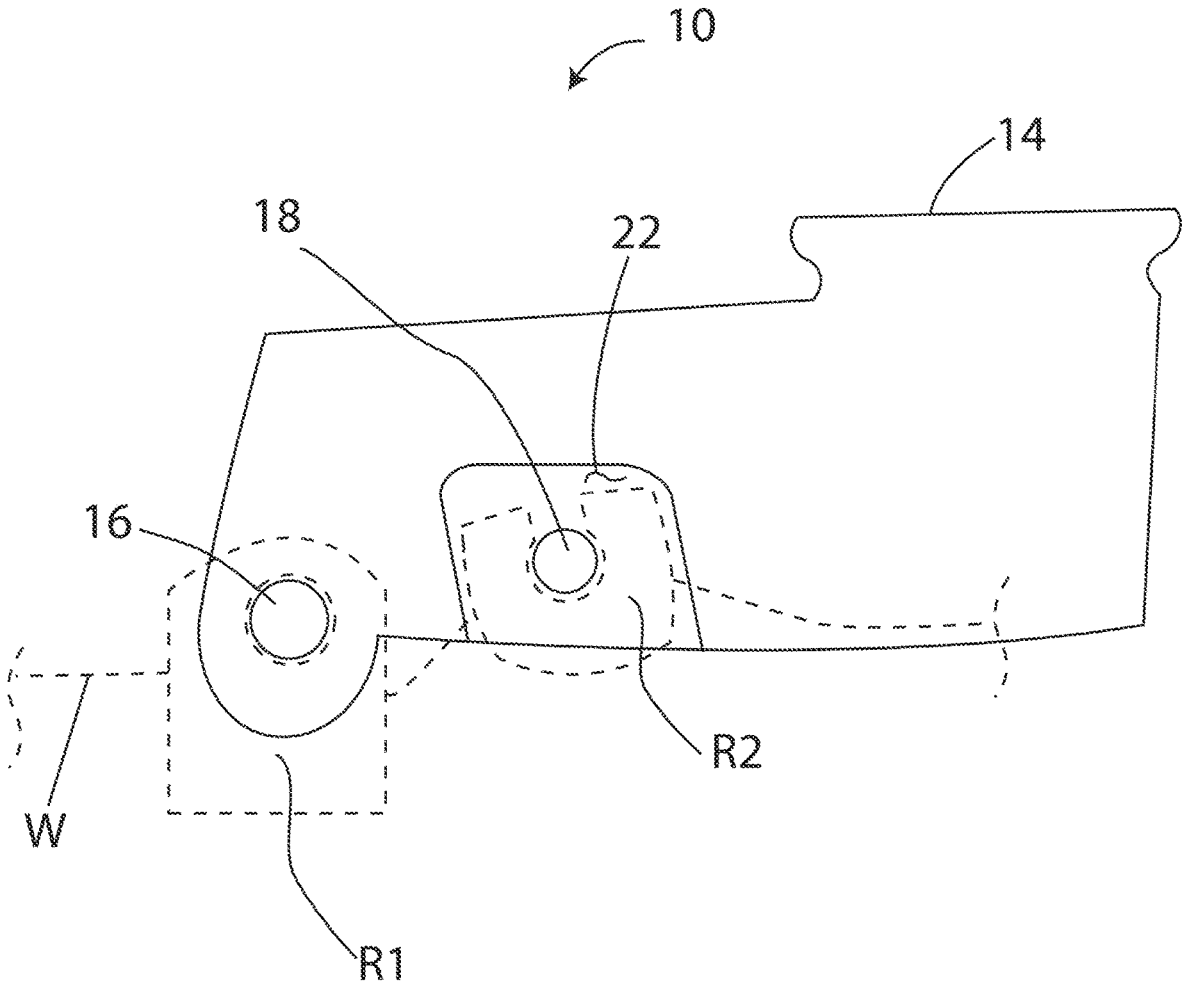
FIG. 6 is a schematic cross-sectional illustration showing the weapon accessory mount at a second, fully installed position in relation to the weapon.

Referring now to FIGS. 5-6, the weapon attachment interface 15 is configured for mounting the weapon accessory mount on a weapon W that comprises a weapon pin receiver R1 and weapon pin retainer R2. The weapon pin receiver R1 comprises a body with a cylindrical recess configured for receiving the alignment pin 16. The cantilevered alignment pin 16 is configured to be inserted axially (by movement along its axis) into the weapon pin receiver R1. With the alignment pin 16 received in the weapon pin receiver R1, the weapon accessory mount 10 can rotate about the axis PA1 of the alignment pin 16. The weapon pin retainer R2 comprises a U-shaped body defining a cavity sized and arranged so that the retaining pin 18 can be inserted into the weapon pin retainer R2 through its open top end and be secured to the weapon pin retainer R2 by snap fit. To install the weapon accessory mount 10 on the weapon, the alignment pin 16 is configured to be inserted axially into the weapon pin receiver R1 while the weapon accessory mount 10 is in a first rotational orientation about the alignment pin axis PA1. FIG. 5 schematically illustrates the weapon accessory mount 10 when the alignment pin 16 is received in the pin receiver R1 and the weapon accessory mount is in a first rotational orientation about the alignment pin axis PA1. From the position shown in FIG. 5, the weapon accessory mount 10 can be rotated about the alignment pin axis PA1 in a coupling rotational direction RD to a second rotational orientation (shown in FIG. 6) where the weapon accessory mount 10 attaches to the weapon W. As the weapon accessory mount 10 rotates, the retaining pin 18 snaps into the weapon pin retainer R2 to couple the weapon accessory mount 10 to the weapon W by snap fit.

The accessory rail 14 is generally configured for interchangeably coupling a plurality of weapon accessories of different types to the weapon accessory mount 10. The accessory rail 14 comprises a longitudinal rail axis LRA transverse to the lateral axis LTA. In the illustrated embodiment, the accessory rail 14 is longer than the base 12. In an exemplary embodiment, the front end portion 13A of the base 12 can further comprise a concavity 38 to provide clearance for the plurality of weapon accessories. A front end portion 21A of the accessory rail 14 protrudes forward of the front end portion 13A of the base 12, and a rear end portion 21B of the accessory rail 14 protrudes rearward of the rear end portion 13B of base 12. As shown in FIG. 2, the accessory rail 14 comprises an upper surface that extends in an upper accessory rail surface plane SP. In the illustrated embodiment, the upper accessory rail surface plane SP is skewed with respect to the lateral axis LTA.

As shown in FIG. 3, the accessory rail 14 can comprise a plurality of mounting grooves 28 spaced apart along the longitudinal rail axis LRA. Some of the plurality of mounting grooves 28 are open for slidably receiving a complementary mounting tongue of a weapon accessory (not shown). The mounting tongue of a weapon accessory can be inserted laterally into one of the open mounting grooves 30 configured for reception. In the illustrated embodiments, some of the mounting grooves 28 are also closed mounting grooves 36. The illustrated accessory rail 14 comprises accessory interference locators 32 in each of the closed mounting grooves 36. The accessory interference locators 32 are configured to block the reception of the mounting tongue of a weapon accessory in the respective grooves. In the illustrated embodiment, the accessory interference locators 32 comprise dome-shaped protrusions protruding up from the bottom surface of each closed mounting groove 36, but it will be understood that any structure capable of blocking reception of a mounting tongue into a mounting groove can be used without departing from the scope of the disclosure. The accessory interference locators 32 can be used to define weapon accessory-specific locations along the accessory rail 14, wherein the weapon accessory should not be mounted to.

Figure 7:
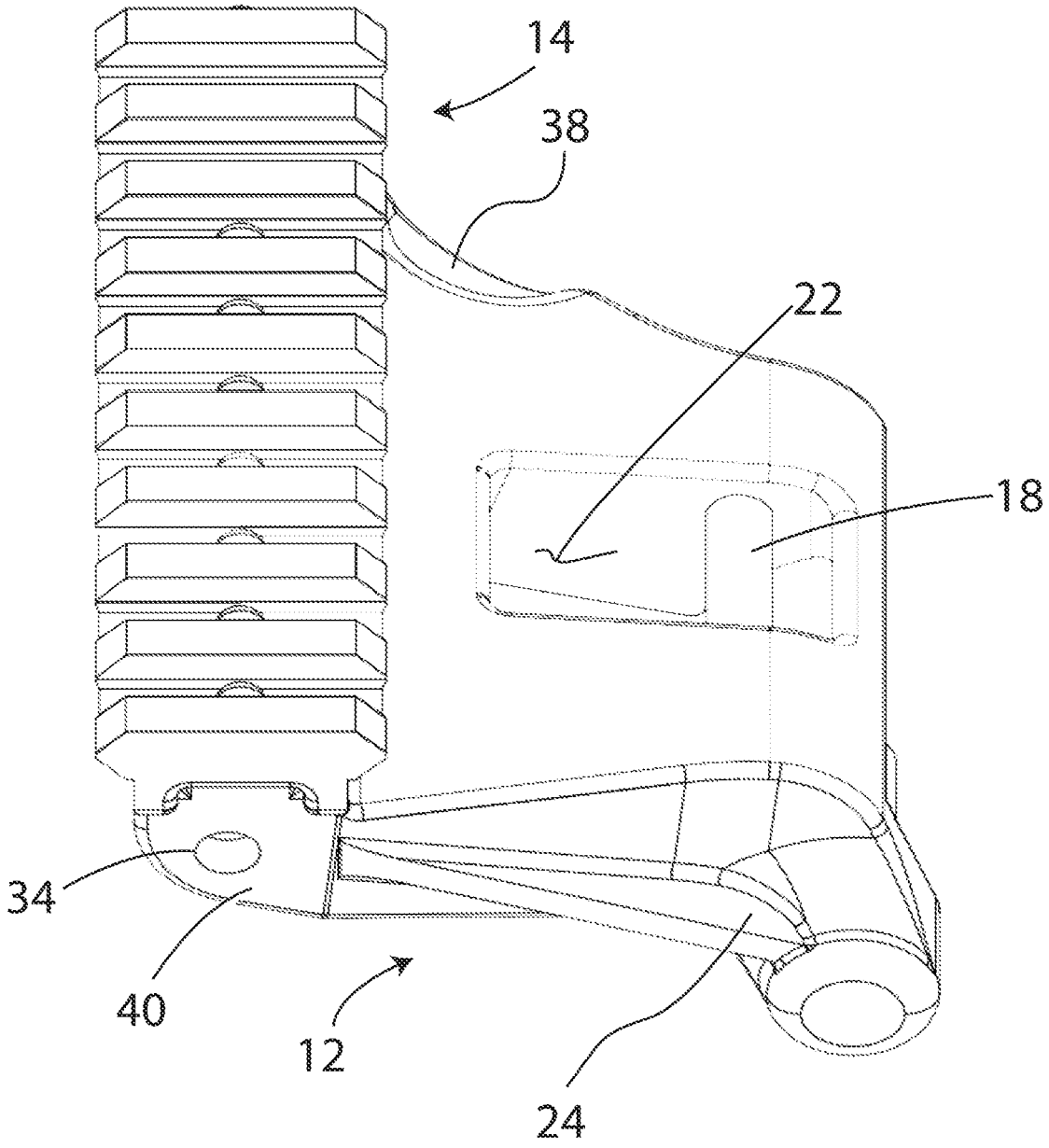
FIG. 7 is another perspective of the weapon accessory mount.

As shown in FIG. 7, in an exemplary embodiment, the weapon accessory mount incorporates a lanyard attachment 34 at a corner of the base 12 where the rear end portion 13B of the base 12 meets the second side portion 11B. The lanyard attachment defines a hole at which the weapon accessory mount 10 can be attached to a lanyard and further tethered to an operator. In the illustrated embodiment, the lanyard attachment 34 is located below the longitudinally protruding rear end portion 21B of the accessory rail 14. As shown in FIG. 7, the rear end portion 21B of the accessory rail 14 comprises a lower recess 40 providing support around the lanyard attachment 34. Note that the longitudinally protruding front end portion 21A of the accessory rail 14 does not possess the same lower recess 40 as the rear end portion in the illustrated embodiment.

An exemplary method of using the weapon accessory mount 10 will now be briefly described. One aspect of using the weapon accessory mount 10 involves securing the accessory mount 10 to the weapon W. To secure the weapon accessory mount 10 to the weapon W, the alignment pin 16 is inserted into the weapon pin receiver R1 (as best seen in FIG. 5). With the alignment pin 16 in the weapon pin receiver R1, the weapon accessory mount 10 is rotated about the alignment pin axis PA1 until the retaining pin 18 is received in the weapon pin retainer R2 and secures by snap fit. Another aspect of using the weapon accessory mount 10 involves securing a weapon accessory to the accessory rail 14. The weapon accessory can be secured to the accessory rail 14 before or after mounting the weapon accessory mount 10 on the weapon W. A weapon accessory can be coupled to the weapon accessory rail 14 by inserting one or more mounting tongues of the weapon accessory laterally into one or more open mounting grooves 30 of the weapon accessory rail 14. During the step of securing the weapon accessory to the weapon accessory rail 14, the accessory interference locators 32 prevent attachment of the accessory to the closed mounting grooves 36.

In an exemplary embodiment, the weapon accessory is a non-boresight aligned optic. When the weapon accessory mount 10 is mounted on the weapon W and the non-boresight aligned optic is secured to the rail 14, the weapon accessory mount 10 locates the non-boresight aligned optic in relation to the weapon so that an operator can super elevate the weapon and use the non-boresight aligned optic to track a moving target.

As will now be understood, the weapon accessory mount 10 provides a common weapon attachment interface for mounting a variety of weapon accessory types (scopes, laser sights, laser range finders, etc.) to a weapon. As the weapon accessory mount 10 can be made from a single piece of material, there are no moving parts that require extra maintenance. The weapon accessory mount 10 can be sized to fit in the same storage case as a weapon accessory that is to be used with the weapon accessory mount 10. The usability of the weapon accessory mount 10 enhances an operator's capability of correctly adapting a weapon with various attachment accessories that enhance the operator's overall ability to find, fix, track and identify a target. The inventors believe the weapon accessory mount 10 is particularly useful for mounting non-boresight aligned optics on a weapon for use in target tracking with a super-elevated weapon.

Figure 8:
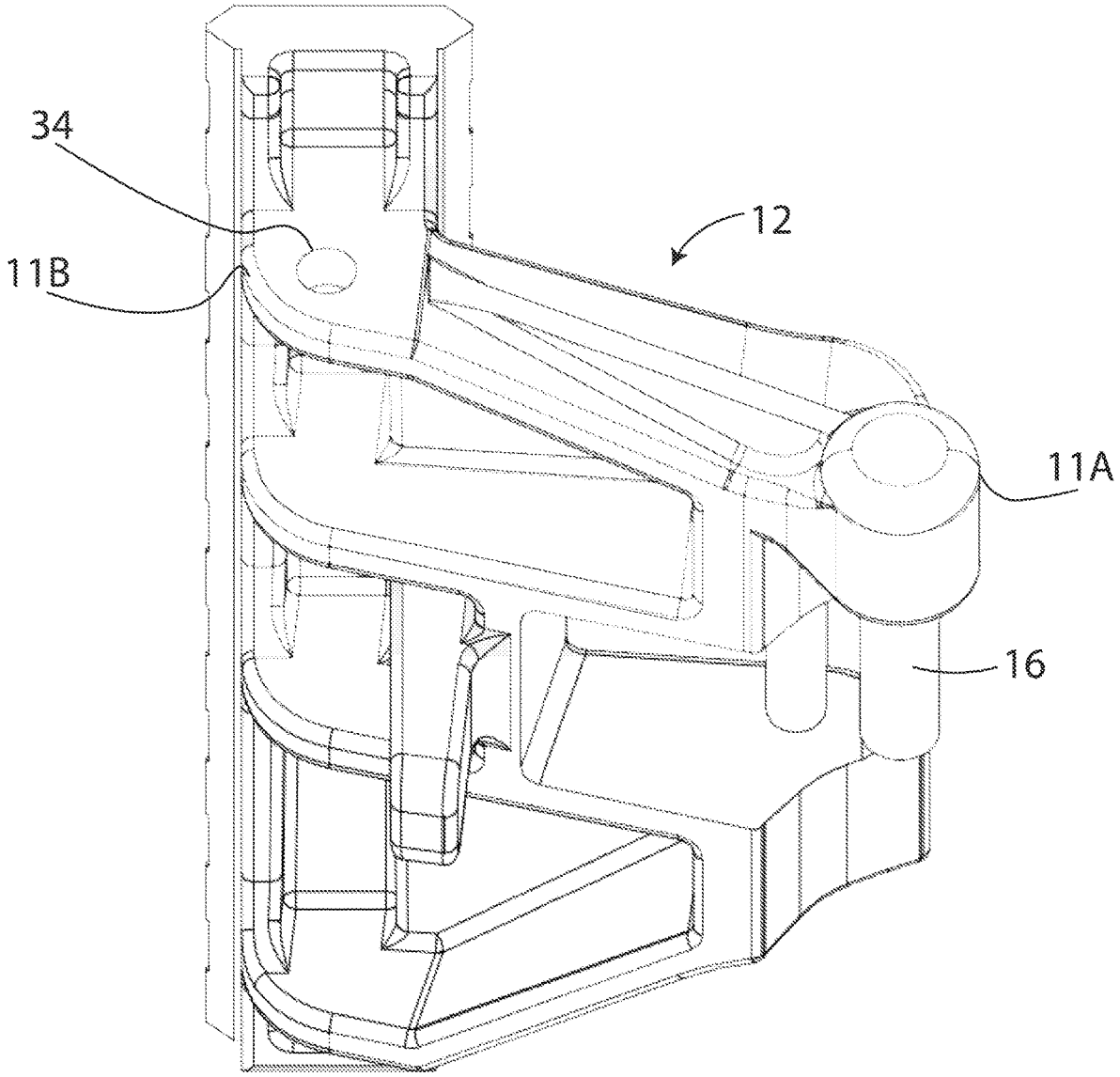
FIG. 8 is another perspective of the weapon accessory mount.
Figure 9:
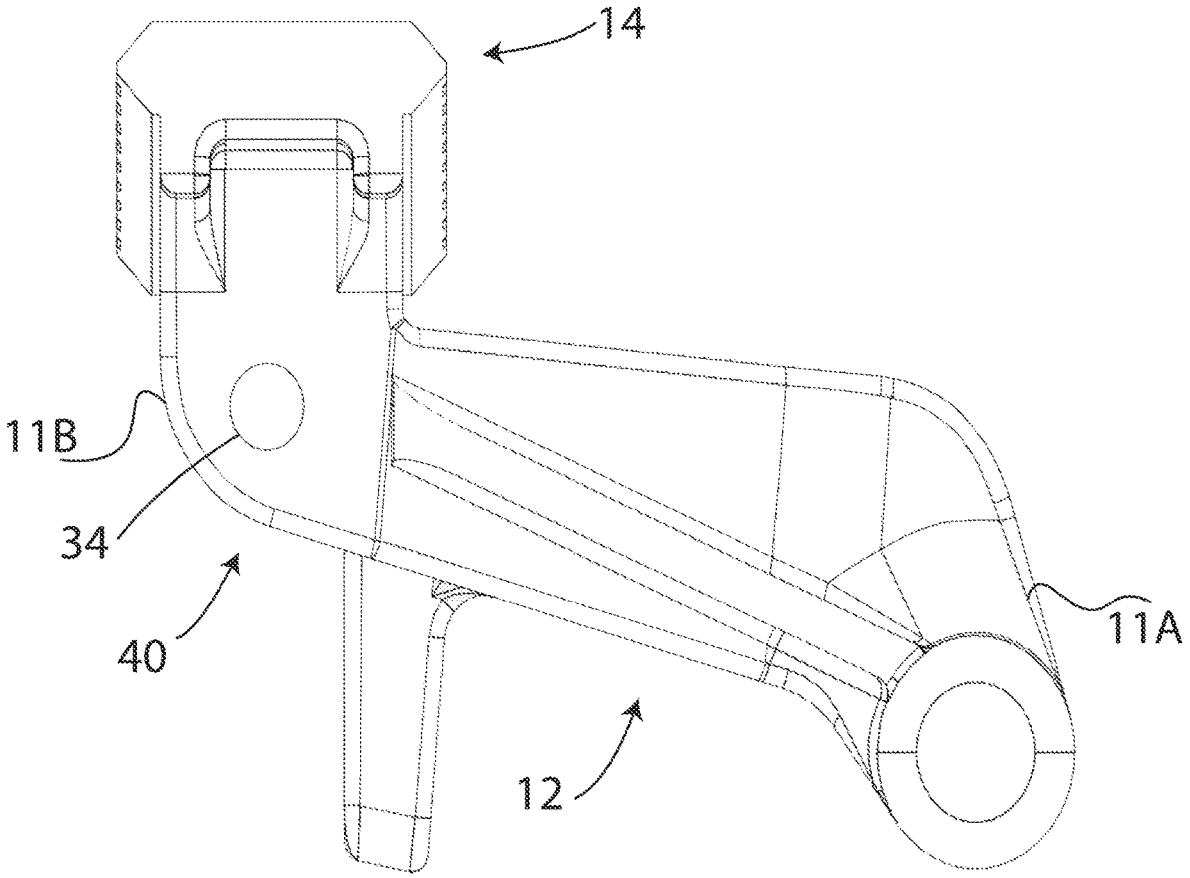
FIG. 9 is another perspective of the weapon accessory mount.

FIGS. 8 and 9 show additional perspective views of the weapon accessory mount 10 to provide a better illustration of some of the features and embodiments discussed above.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A weapon accessory mount for mounting an accessory on a weapon, the weapon accessory mount comprising:

a base having a first side portion and second side portion spaced apart along a lateral axis of the weapon accessory mount, the base comprising a weapon attachment interface along the first side portion, the weapon attachment interface comprising an alignment pin anchored to the base, having an alignment pin axis, configured to rotatably interface with a pin receiver of the weapon for attaching the weapon accessory mount to the weapon; and an accessory rail for interchangeably coupling to a plurality of weapon accessories, the accessory rail comprising a longitudinal rail axis transverse to the lateral axis, the accessory rail being supported on the second side portion of the base such that the weapon accessory mount is configured to mount the accessory rail on the weapon at a location that is laterally offset from where the weapon attachment interface attaches the weapon accessory mount to the weapon.

2. A weapon accessory mount for mounting an accessory on a weapon, the weapon accessory mount comprising:

a base having a first side portion and second side portion spaced apart along a lateral axis of the weapon accessory mount, the base comprising a weapon attachment interface along the first side portion, the weapon attachment interface comprising an alignment pin, having an alignment pin axis, configured to rotatably interface with a pin receiver of the weapon for attaching the weapon accessory mount to the weapon; and an accessory rail for interchangeably coupling to a plurality of weapon accessories, the accessory rail comprising a longitudinal rail axis transverse to the lateral axis, the accessory rail being supported on the second side portion of the base such that the weapon accessory mount is configured to mount the accessory rail on the weapon at a location that is laterally offset from where the weapon attachment interface attaches the weapon accessory mount to the weapon, wherein the alignment pin has a front end portion and a rear end portion spaced apart along the alignment pin axis, the alignment pin being anchored to the base at only the rear end portion such that the alignment pin is cantilevered from the rear end portion of the alignment pin.

3. The weapon accessory mount of claim 2, wherein the weapon attachment interface further comprises a retaining pin configured to couple to a pin retainer of the weapon for attaching the weapon accessory mount to the weapon.

4. The weapon accessory mount of claim 3, wherein the retaining pin is configured to couple to the pin retainer by snap fit.

5. The weapon accessory mount of claim 3, wherein the alignment pin is configured to be inserted into the pin receiver while the weapon accessory mount is in a first rotational orientation about the alignment pin axis.

6. The weapon accessory mount of claim 4, wherein the retaining pin is configured to couple to the pin retainer by rotating the weapon accessory mount about the alignment pin axis from the first rotational orientation to a second rotational orientation with the alignment pin in the pin receiver.

7. The weapon accessory mount of claim 3, wherein the retaining pin has a retaining pin axis parallel to the alignment pin axis.

8. The weapon accessory mount of claim 3, wherein the retaining pin is spaced apart from the alignment pin along the lateral axis such that the retaining pin is laterally between the alignment pin and the accessory rail.

9. The weapon accessory mount of claim 3, wherein the weapon accessory mount has a vertical axis perpendicular to the alignment pin axis and the lateral axis.

10. The weapon accessory mount of claim 9, wherein the retaining pin is spaced apart above the alignment pin along the vertical axis.

11. The weapon accessory mount of claim 2, wherein the base comprises a lower back corner protrusion, the alignment pin being anchored in the lower back corner protrusion.

12. The weapon accessory mount of claim 2, wherein the accessory rail has an upper accessory rail surface extending in an upper accessory rail surface plane, the upper accessory rail surface plane being skewed with respect to the lateral axis.

13. The weapon accessory mount of claim 2, wherein the longitudinal rail axis is skewed with respect to the alignment pin axis.

14. The weapon accessory mount of claim 2, wherein the accessory rail comprises a plurality of mounting grooves spaced apart along the longitudinal rail axis, at least some of the mounting grooves configured to slidably receive a complementary mounting tongue of a weapon accessory inserted laterally into the mounting groove.

15. The weapon accessory mount of claim 14, wherein the accessory rail comprises accessory interference locators in a plurality of the mounting grooves configured for blocking reception of the complementary mounting tongue in the respective mounting grooves.

16. The weapon accessory mount of claim 2, wherein the base has a length extending from a front end portion to a rear end portion and wherein the accessory rail has a front end portion and rear end portion spaced apart along the longitudinal rail axis, the rear end portion of the accessory rail protruding rearward of the rear end portion of the base.

17. The weapon accessory mount of claim 16, wherein the front end portion of the accessory rail protrudes forward of the front end portion of the base.

18. A weapon accessory mount for mounting an accessory on a weapon, the weapon accessory mount comprising:

a base having a first side portion and second side portion spaced apart along a lateral axis of the weapon accessory mount, the base comprising a weapon attachment interface along the first side portion, the weapon attachment interface comprising an alignment pin, having an alignment pin axis, configured to rotatably interface with a pin receiver of the weapon for attaching the weapon accessory mount to the weapon; and a retaining pin configured to couple to a pin retainer of the weapon for attaching the weapon accessory mount to the weapon;

an accessory rail for interchangeably coupling to a plurality of weapon accessories, the accessory rail comprising a longitudinal rail axis transverse to the lateral axis, the accessory rail being supported on the second side portion of the base such that the weapon accessory mount is configured to mount the accessory rail on the weapon at a location that is laterally offset from where the weapon attachment interface attaches the weapon accessory mount to the weapon, wherein the base comprises a retaining pin recess, the retaining pin being received in the retaining pin recess.

19. The weapon accessory mount of claim 18, wherein the base comprises a front portion in front of the retaining pin recess and a rear portion behind the retaining pin recess, the retaining pin comprising a front end portion anchored in the front portion of the base and a rear end portion anchored in the rear end portion such that the retaining pin is supported from both the front and rear end portions.

20. The weapon accessory mount of claim 19, wherein a rear end portion of the alignment pin is spaced apart behind the retaining pin recess and wherein a front end portion of the alignment pin is aligned with the retaining pin recess such that a plane extending radially from the front end portion of the alignment pin with respect to the alignment pin axis intersects the retaining pin.

* * * * *